US011280133B2

(12) United States Patent
Badowski

(10) Patent No.: US 11,280,133 B2
(45) Date of Patent: Mar. 22, 2022

(54) 7000 SERIES ALUMINUM ALLOY LADDER, MULTIPURPOSE LADDER AND METHOD

(71) Applicant: Clint D. Badowski, Mercer, PA (US)

(72) Inventor: Clint D. Badowski, Mercer, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 15/883,958

(22) Filed: Jan. 30, 2018

(65) Prior Publication Data

US 2019/0234144 A1 Aug. 1, 2019

(51) Int. Cl.

| | |
|---|---|
| ***E06C 7/08*** | (2006.01) |
| ***B21C 23/00*** | (2006.01) |
| ***C21D 1/18*** | (2006.01) |
| ***E06C 1/22*** | (2006.01) |
| ***C21D 1/84*** | (2006.01) |
| ***C21D 9/04*** | (2006.01) |
| ***C22C 21/10*** | (2006.01) |
| ***C21D 1/613*** | (2006.01) |
| ***C22F 1/053*** | (2006.01) |
| ***E06C 7/42*** | (2006.01) |
| ***E06C 1/12*** | (2006.01) |
| ***E06C 1/06*** | (2006.01) |
| ***E06C 1/18*** | (2006.01) |

(52) U.S. Cl.

CPC ..... *E06C 7/082* (2013.01); *B21C 23/002* (2013.01); *C21D 1/18* (2013.01); *C21D 1/613* (2013.01); *C21D 1/84* (2013.01); *C21D 9/04* (2013.01); *C22C 21/10* (2013.01); *C22F 1/053* (2013.01); *E06C 1/06* (2013.01); *E06C 1/12* (2013.01); *E06C 1/18* (2013.01); *E06C 1/22* (2013.01); *E06C 7/081* (2013.01); *E06C 7/423* (2013.01)

(58) Field of Classification Search

CPC ..... E06C 7/082; E06C 1/22; B21C 23/002; C21D 1/18; C21D 1/613; C21D 1/84; C21D 9/04; C22C 21/10

See application file for complete search history.

(56) References Cited

U.S. PATENT DOCUMENTS

| | | | | |
|---|---|---|---|---|
| 4,182,431 A * | 1/1980 | Wing | E06C 1/12 | 182/167 |
| 4,371,055 A * | 2/1983 | Ashton | E06C 1/12 | 156/166 |
| 4,376,470 A * | 3/1983 | Ashton | E06C 1/22 | 182/207 |
| 6,220,389 B1 * | 4/2001 | Krause | E06C 1/12 | 182/163 |
| 7,306,075 B2 * | 12/2007 | Winslow | E06C 1/18 | 16/357 |
| 8,186,481 B2 * | 5/2012 | Moss | E06C 1/18 | 182/129 |

(Continued)

OTHER PUBLICATIONS

Toshihiko, Weldability of 7000 series aluminum alloy materials, Oct. 10, 2011, Welding International (Year: 2011).*

(Continued)

*Primary Examiner* — Colleen M Chavchavadze
*Assistant Examiner* — Candace L Bradford
(74) *Attorney, Agent, or Firm* — Ansel M. Schwartz

(57) ABSTRACT

A ladder and a multipurpose ladder whose rungs and rails are made out of 7000 series aluminum alloy and which has a duty rating of at least 250 lbs. A method for producing a ladder. A method for using a ladder.

7 Claims, 10 Drawing Sheets

(56) References Cited

U.S. PATENT DOCUMENTS 8,701,828 B1 * 4/2014 Matthew ..... E06C 7/182
182/129
9,016,434 B2 * 4/2015 Moss ..... E06C 7/182
182/106
10,343,727 B1 * 7/2019 Hihara ..... B62D 29/001
2002/0142183 A1 * 10/2002 Colligan ..... B23K 20/2336
428/593
2003/0146047 A1 * 8/2003 Simpson ..... E06C 1/32
182/23
2003/0217888 A1 * 11/2003 Simpson ..... E06C 1/18
182/23
2003/0221910 A1 * 12/2003 Huang ..... E06C 1/22
182/163
2005/0121261 A1 * 6/2005 Moss ..... E06C 7/423
182/165
2006/0292392 A1 * 12/2006 Froning ..... B32B 15/01
428/659
2009/0229918 A1 * 9/2009 Moss ..... E06C 7/16
182/129
2014/0360712 A1 * 12/2014 Fujita ..... C22C 21/10
165/185
2016/0153231 A1 * 6/2016 Kieffer ..... E06C 1/125
182/163
2017/0254145 A1 * 9/2017 Ballard ..... E06C 7/16
2017/0260809 A1 * 9/2017 Leng ..... E06C 1/38
2017/0356244 A1 * 12/2017 Peterson ..... E06C 1/10
2018/0238112 A1 * 8/2018 Era ..... E06C 1/22

OTHER PUBLICATIONS

Summer, Insider's Look: 7000 series aluminum alloy innovation, Aug. 19, 2015, Novelis Blog, Novelis (Year: 2015).*
The Best Aluminum Alloys for Welding, Apr. 5, 2017, Clinton Aluminum Innovative Alloys (Year: 2017).*
Starks, Aluminum Welding, May 1, 2016, Clinton Aluminum (Year: 2016).*

* cited by examiner

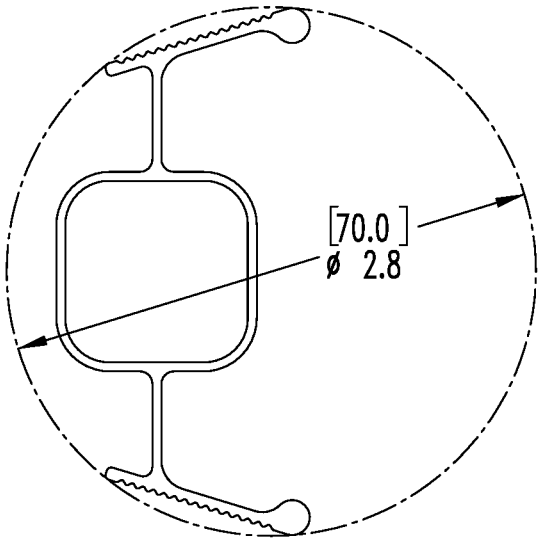
FIG.4B ACTUAL SIZE
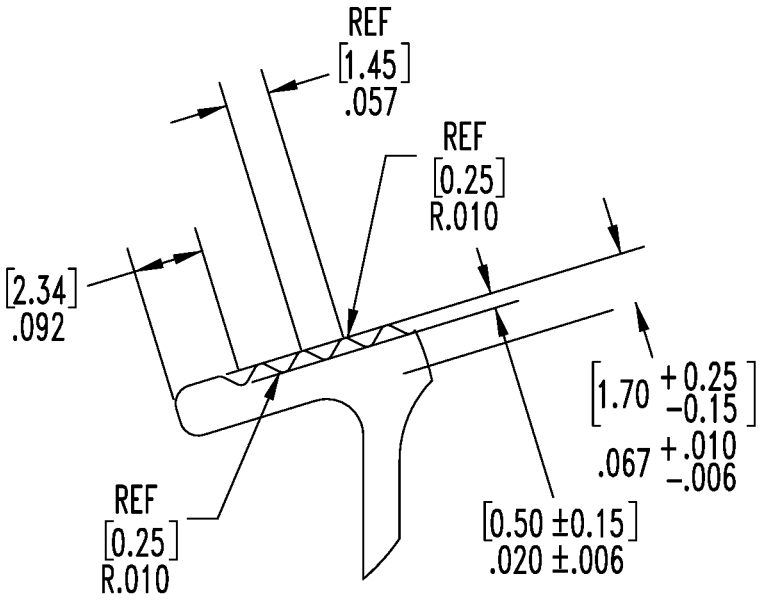
FIG.4C

A

| The extrusion technology for MT1AA-00A | | | | | |
|---|---|---|---|---|---|
| Alloy | mold number of xx | Part number of profile (WERNER) | Name | extrusion press | Aluminum rod temperature ℃ |
| 7005 | 26-269 | 114402 | MTIAA-22A Inner rail | 11MN | 475-495 |
| | 26-270 | 114403 | MTIAA-26A Inner rail (right) | | 475-495 |
| | 26-271 | 114404 | MTIAA-26A Inner rail (left) | | 475-495 |
| | 26-275 | N/A | Hinge plate | 18MN | 475-495 |
| 7005A | 26-267 | 114400 | MTIAA-13A Inner rail | 8MN | 485-505 |
| | 26-268 | 114401 | MTIAA-17A Inner rail | 8MN | 485-505 |
| | 26-272 | 114561 | Rear brace | 8MN | 485-505 |
| | 26-276 | | Knee brace of MTIAA-26A | 8MN | 485-505 |
| | 26-279 | | Knee brace except MTIAA-26A | 8MN | 485-505 |
| | 26-278 | 114005 | MTIAA-13A and MTIAA-17A outer rail | 11MN | 485-505 |
| | 26-280 | 114013 | MTIAA-22A and MTIAA-26A outer rail | 11MN | 485-505 |
| | 26-273 | 114418 | Inner rung | 11MN | 485-505 |
| | 26-274 | 114428 | outer top rung | 8MN | 485-505 |
| | 26-277 | 114010 | outer rung (MTIAA-26A) | 8MN | 485-505 |
| | 26-281 | 114004 | outer rung | 8MN | 485-505 |

FIG. 7A

B

A

| The extrusion technology for MT1AA-00A | | | | | | |
|---|---|---|---|---|---|---|
| extrusion technology | | | | Physical properties | | |
| Outlet temperature °C | Quenching | Aging | speed | T.S MPa | Y.S MPa | Elongation % |
| >500 | Strong wind cold+Spray | 100°C°5h+155°C°8h, AIR-COOLED | 2-3 5MM/S (adjusted according to the actual situation | 370 | 330 | 10 |
| >500 | Strong wind cold+Spray | 100°C°5h+155°C°8h, AIR-COOLED | 2-3 5MM/S (adjusted according to the actual situation | 370 | 330 | 10 |
| >500 | Strong wind cold+Spray | 100°C°5h+155°C°8h, AIR-COOLED | 2-3 5MM/S (adjusted according to the actual situation | 370 | 330 | 10 |
| >500 | Cross water | 100°C°5h+155°C°8h, AIR-COOLED | 2-5MM/S (adjusted according to the actual situation | 370 | 330 | 10 |
| >510 | Strong wind cold | 180°C°8h. Air-cooled | 2-3.5MM/S (adjusted according to the actual situation | 340 | 310 | 10 |
| >510 | Strong wind cold | 180°C°8h. Air-cooled | 2-3.5MM/S (adjusted according to the actual situation | 340 | 310 | 10 |
| >510 | Strong wind cold+Spray | 180°C°5h. Air-cooled | 2-4 5MM/S (adjusted according to the actual situation | 320 | 280 | 10 |
| >510 | Strong wind cold+Spray | 180°C°8h. Air-cooled | 2-4 5MM/S (adjusted according to the actual situation | 320 | 280 | 10 |
| >510 | Cross water | 180°C°8h. Air-cooled | 2-4 5MM/S (adjusted according to the actual situation | 320 | 280 | 10 |
| >510 | Strong wind cold | 180°C°8h. Air-cooled | 2-4.5MM/S (adjusted according to the actual situation | 340 | 310 | 10 |
| >510 | Strong wind cold | 180°C°8h. Air-cooled | 2-4 5MM/S (adjusted according to the actual situation | 350 | 320 | 10 |
| >510 | Strong wind cold | 180°C°5h. Air-cooled | 2-3 5MM/S (adjusted according to the actual situation | 310 | 260 | 10 |
| >510 | Cross water | 180°C°8h. Air-cooled | 2-3 5MM/S (adjusted according to the actual situation | 320 | 280 | 10 |
| >510 | Cross water | 180°C°8h. Air-cooled | 2-3 5MM/S (adjusted according to the actual situation | 320 | 280 | 10 |
| >510 | Cross water | 180°C°8h. Air-cooled | 2-3 5MM/S (adjusted according to the actual situation | 320 | 280 | 10 |

B

FIG. 7B

7000 SERIES ALUMINUM ALLOY LADDER, MULTIPURPOSE LADDER AND METHOD

FIELD OF THE INVENTION

The present invention is related to a ladder, including a multipurpose ladder whose rungs and rails are made out of 7000 series aluminum alloy and which has a duty rating of at least 300 lbs. (As used herein, references to the "present invention" or "invention" relate to exemplary embodiments and not necessarily to every embodiment encompassed by the appended claims.) More specifically, the present invention is related to a ladder, including a multipurpose ladder whose rungs and rails are made out of 7000 series aluminum alloy and which has a duty rating of at least 300 lbs. and has no cracks.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

MT ladders greatest advantage is versatility. The product can be used in 5 different positions at multiple heights depending on the size of the product. (Step ladder, stairway ladder, scaffold bases, wall ladder, and straight/extension ladder.) The biggest issue with such products today is the weight of the products themselves. This presents issues for transporting the ladder to the work area, taking in and out of storage, and setting the ladder into the proper position.

Trying to manipulate the product to get it into the proper setting can even cause the user to need assistance. This is where 7000 series alloys aluminum product is superior to the 6000 series alloys product. The 7000 series alloys are higher in strength while maintaining the same density, which allows the weight of the product to be lowered and the performance not to suffer. This allows less material to be used and reach the same strength properties, but this does not come easy. Using 7000 series alloys come with challenges. One being that with the increased strength also comes with more brittleness. The material has to be processed differently and the products have to be designed differently to keep issues like stress cracking from showing up. The use of 7000 series Al Alloy is also applicable to ladders in general for the strength the material affords in regard to the relative lighter weight that is always helpful for users when moving ladders.

BRIEF SUMMARY OF THE INVENTION

The present invention pertains to a multipurpose ladder. The ladder comprises a first inner section having a first inner right rail, a first inner left rail in parallel and spaced relation with the first inner right rail and a plurality of first inner rungs attached to the first inner left and right rail. The ladder comprises a first articulated hinge attached to the first inner right rail with a first set of fasteners. The ladder comprises a second articulated hinge attached to the first inner left rail with a second set of fasteners. The ladder comprises a second inner section having a second inner right rail, and a second inner left rail in parallel and spaced relation with the second inner right rail and a plurality of second inner rungs attached to the second inner left and right rails. The second inner right rail attached to the first articulated hinge and the second inner left rail attached to the second articulated hinge so the second inner section can rotate about the first and second articulated hinges at least 80° relative to the first inner section. The ladder comprises a first outer section having a first outer right rail, and a first outer left rail 40 in parallel and spaced relation with the first outer right rail and a plurality of first outer rungs attached to the first outer left and right rails. The first outer right rail disposed about the first inner right rail with the first inner right rail sliding up and down relative to the first outer right rail. The first outer right rail having a bend of at least 20° outward relative to the first inner right rail which defines a lower portion below the bend. The ladder comprises a first locking bracket attached to the first outer section which locks the first inner right rail in place relative to the first outer right rail in a locked state and allows the first inner right rail to slide relative to the first outer right rail in the unlocked state. The ladder comprises a second outer section having a second outer right rail, and a second outer left rail in parallel and spaced relation with the second outer right rail and a plurality of second outer rungs attached to the second outer left and right rails. The second outer right rail disposed about the second inner right rail with the second inner right rail sliding up and down relative to the second outer right rail. The first and second inner right rails and the first and second inner left rails and the first and second outer right rails and the first and second outer left rails and the first and second inner rungs and the first and second outer rungs made entirely of 7000 series aluminum alloy.

The present invention pertains to a method for producing an MT ladder. The method comprises the steps of extruding a billet of 7000 series aluminum alloy into an extrusion in a shape of a rail. There is the step of cutting the extrusion at a desired length to define the rail. There is the step of bending the rail into a desired shape for a first outer right rail so no cracks occur in the first outer right rail. There is the step of age hardening the first outer right rail. There is the step of constructing the ladder with the first outer right rail.

The present invention pertains to a ladder. The ladder comprises a right rail. The ladder comprises a left rail in parallel and spaced relation with the right rail. The ladder comprises a plurality of rungs attached to the left and right rails, the right and the left rails and the rungs made entirely of 7000 series aluminum alloy.

The present invention pertains to a method for producing a ladder. The method comprises the steps of extruding a billet of 7000 series aluminum alloy into an extrusion in a shape of a rail. There is the step of cutting the extrusion at a desired length to define the rail. There is the step of age hardening the rail to define a right rail. There is the step of attaching a rung made of 7000 series Al alloy to the right rail. There is the step of constructing the ladder with the right rail and the rung. The ladder 70 has a duty rating of at least 250 lbs.

The present invention pertains to a method for using a ladder. The method comprises the steps of moving the ladder to a desired location. The ladder having rails and rungs attached to the rails. The rungs and the rails made entirely of 7000 series aluminum alloy. There is the step of positioning the ladder for a user to climb up onto the ladder.

BRIEF DESCRIPTION OF THE SEVERAL VIEWS OF THE DRAWING

In the accompanying drawings, the preferred embodiment of the invention and preferred methods of practicing the invention are illustrated in which:

FIGS. 4A, 4B and 4C are cross sectional views of a rung of the MT ladder.

FIG. 7 is a chart regarding the extrusion of components of the MT ladder.

DETAILED DESCRIPTION OF THE INVENTION

Figure 1:
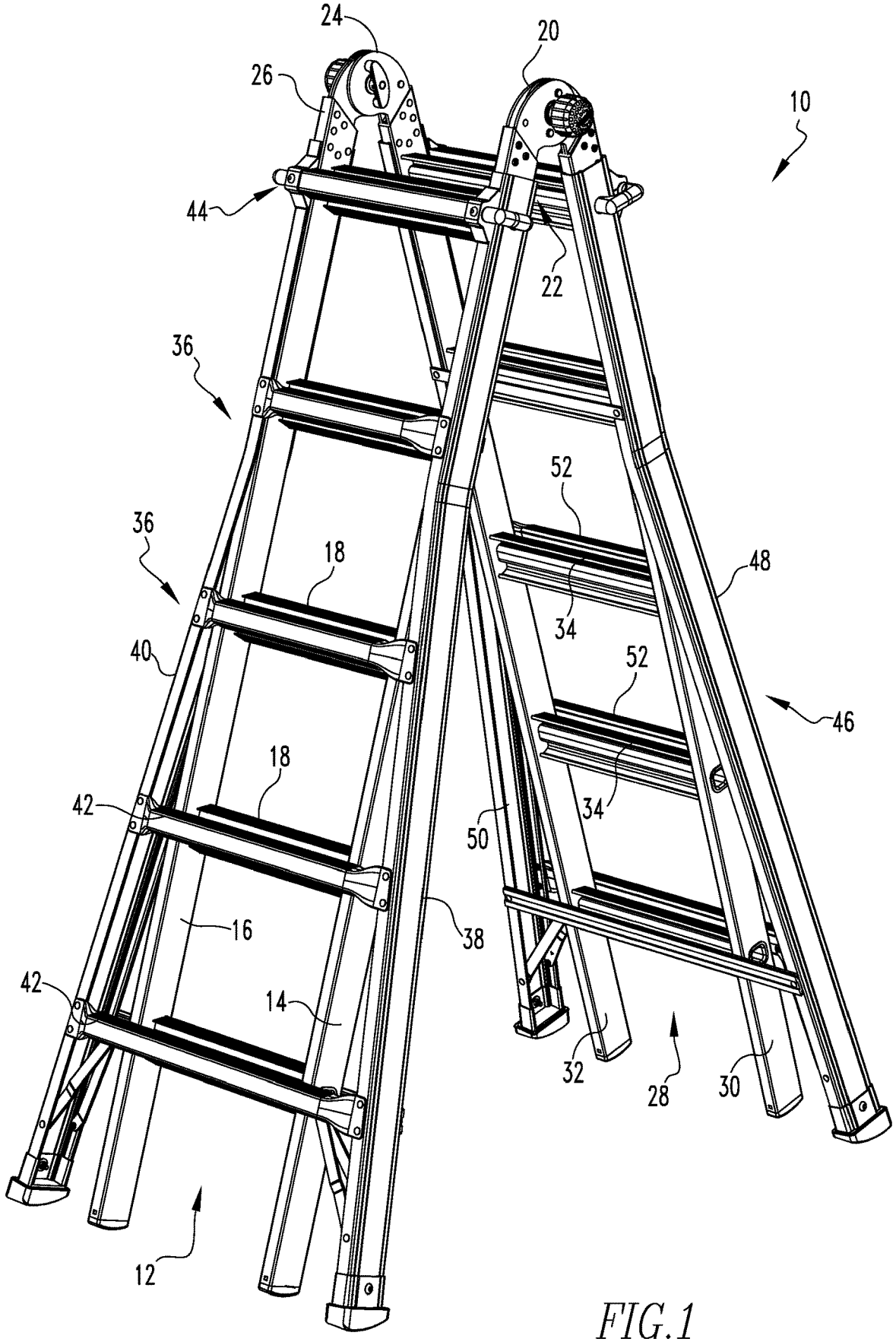
FIG. 1 is a perspective view of an MT ladder of the present invention.

Referring now to the drawings wherein like reference numerals refer to similar or identical parts throughout the several views, and more specifically to FIG. 1 thereof, there is shown a multipurpose ladder 10. The ladder 10 comprises a first inner section 12 having a first inner right rail 14, a first inner left rail 16 in parallel and spaced relation with the first inner right rail 14 and a plurality of first inner rungs 18 attached to the first inner left and right rail. The ladder 10 comprises a first articulated hinge 20 attached to the first inner right rail 14 with a first set of fasteners 22. The ladder 10 comprises a second articulated hinge 24 attached to the first inner left rail 16 with a second set of fasteners 26. The ladder 10 comprises a second inner section 28 having a second inner right rail 30, and a second inner left rail 32 in parallel and spaced relation with the second inner right rail 30 and a plurality of second inner rungs 34 attached to the second inner left and right rails. The second inner right rail 30 attached to the first articulated hinge 20 and the second inner left rail 32 attached to the second articulated hinge 24 so the second inner section 28 can rotate about the first and second articulated hinges 20, 24 at least 80° relative to the first inner section 12. The ladder 10 comprises a first outer section 36 having a first outer right rail 38, and a first outer left rail 40 in parallel and spaced relation with the first outer right rail 38 and a plurality of first outer rungs 42 attached to the first outer left and right rails. The first outer right rail 38 disposed about the first inner right rail 14 with the first inner right rail 14 sliding up and down relative to the first outer right rail 38. The first outer right rail 38 having a bend 56 of at least 20° outward relative to the first inner right rail 14 which defines a lower portion below the bend 56. The ladder 10 comprises a first locking bracket 44 attached to the first outer section 36 which locks the first inner right rail 14 in place relative to the first outer right rail 38 in a locked state and allows the first inner right rail 14 to slide relative to the first outer right rail 38 in the unlocked state. The ladder 10 comprises a second outer section 46 having a second outer right rail 48, and a second outer left rail 50 in parallel and spaced relation with the second outer right rail 48 and a plurality of second outer rungs 52 attached to the second outer left and right rails. The second outer right rail 48 disposed about the second inner right rail 30 with the second inner right rail 30 sliding up and down relative to the second outer right rail 48. The first and second inner right rails 14, 30 and the first and second inner left rails 16, 32 and the first and second outer right rails 38, 48 and the first and second outer left rails 40, 50 and the first and second inner rungs 18, 34 and the first and second outer rungs 42, 52 made entirely of 7000 series aluminum alloy. The first outer left rail 40 and the second outer left and right rails they also have a bend 56 of at least 20° outward relative to the first inner right rail 14 which defines a lower portion below the bend 56.

The bend 56 of the first outer right rail 38 has no cracks, and the first inner right rail 14 has no cracks. The first articulated hinge 20 has no cracks. Each outer rail of the ladder 10 has a bend 56 in it to allow a larger base width of the ladder 10. This bend 56 in this component caused issues when using 7000 series alloys due to the brittleness after aging. Stress cracks would form at the bend 56 due to the materials brittleness post aging. The way this issue was resolved was to extrude the 7000 series AL alloy material, cut the parts to length, bend the rail, and then age the material/component. When using 6000 series, the material instead was extruded, the material was aged, the parts were cut to length, and then the rails were bent. Aging the material post bending prevented the stress cracks from forming.

Figure 2:
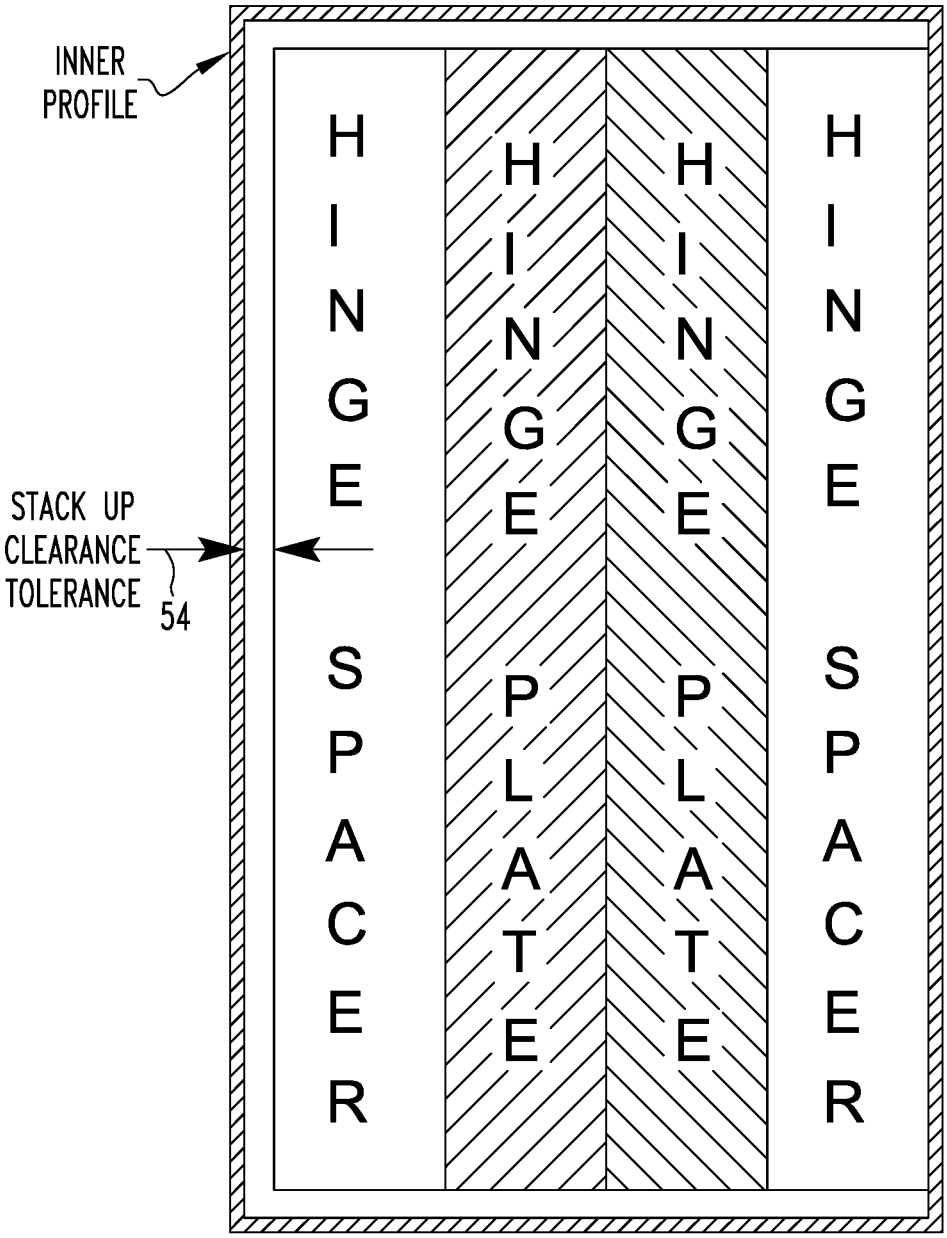
FIG. 2 is schematic representation showing the stack up clearance regarding a hinge and rail of the MT ladder.
Figure 3:
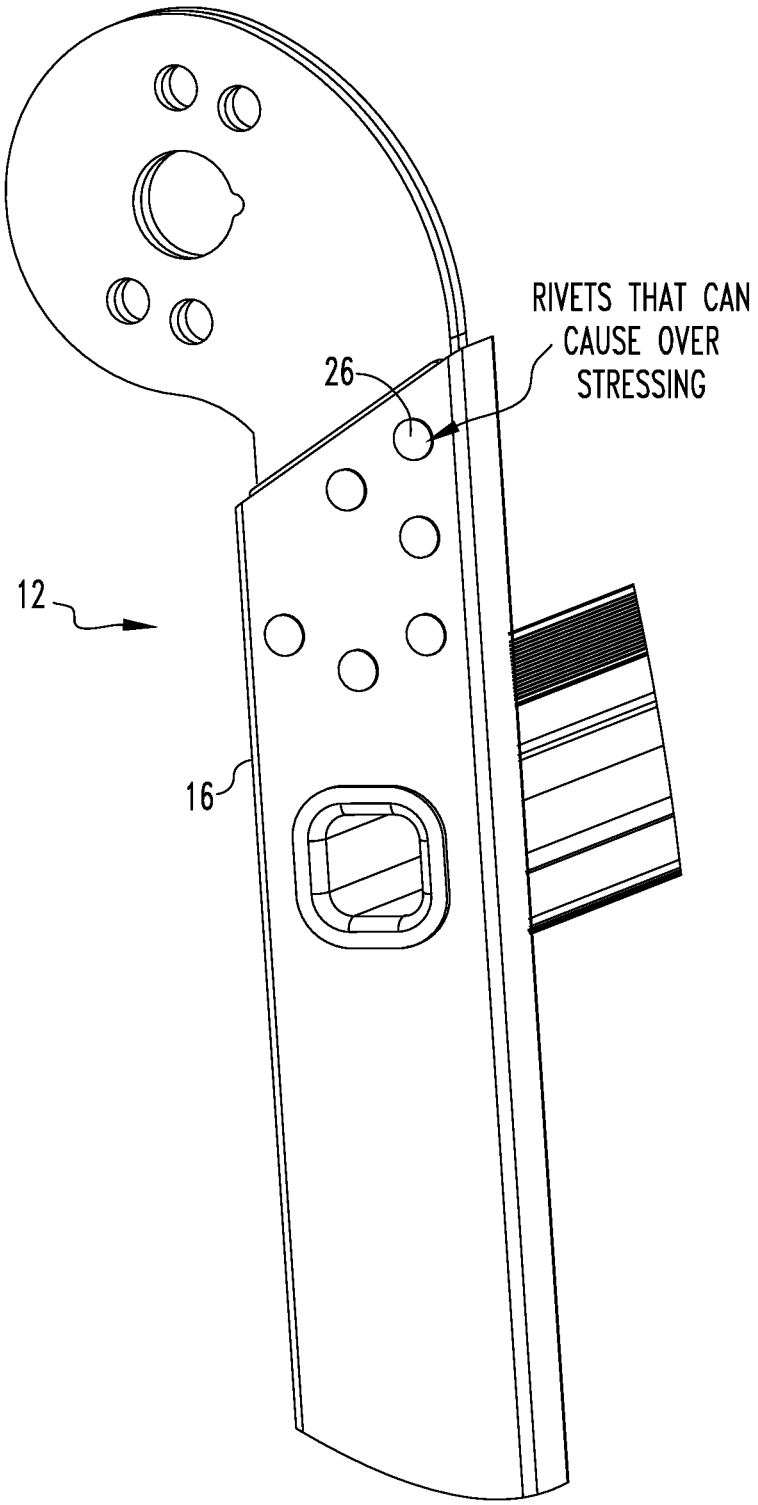
FIG. 3 shows rivets which can cause stressing cracking regarding a hinge of the MT ladder.

A stack up clearance 54 with respect to the first inner right rail 14 and the first articulated hinge 20 and the first set of fasteners 22 may be 0.082" at maximum, 0.040" at nominal, and may have an interference of 0.006" at minimum. See FIG. 2. With the standard 6000 series Al Alloy ladder, the stack up clearance 54 between the inner rail and the hinge was 0.094" at maximum, 0.042" at nominal, and an interference of 0.002" at minimum. With the 7000 series Al Alloy the clearance had to be tightened to avoid the riveting operation stress cracking the inner rail. See FIG. 3. The stack up clearance 54 between the inner rail and the hinge on the 7000 material was 0.082" at maximum, 0.040" at nominal, and an interference of 0.006" at minimum. This prevented the material from being over stressed.

Figure 4A:
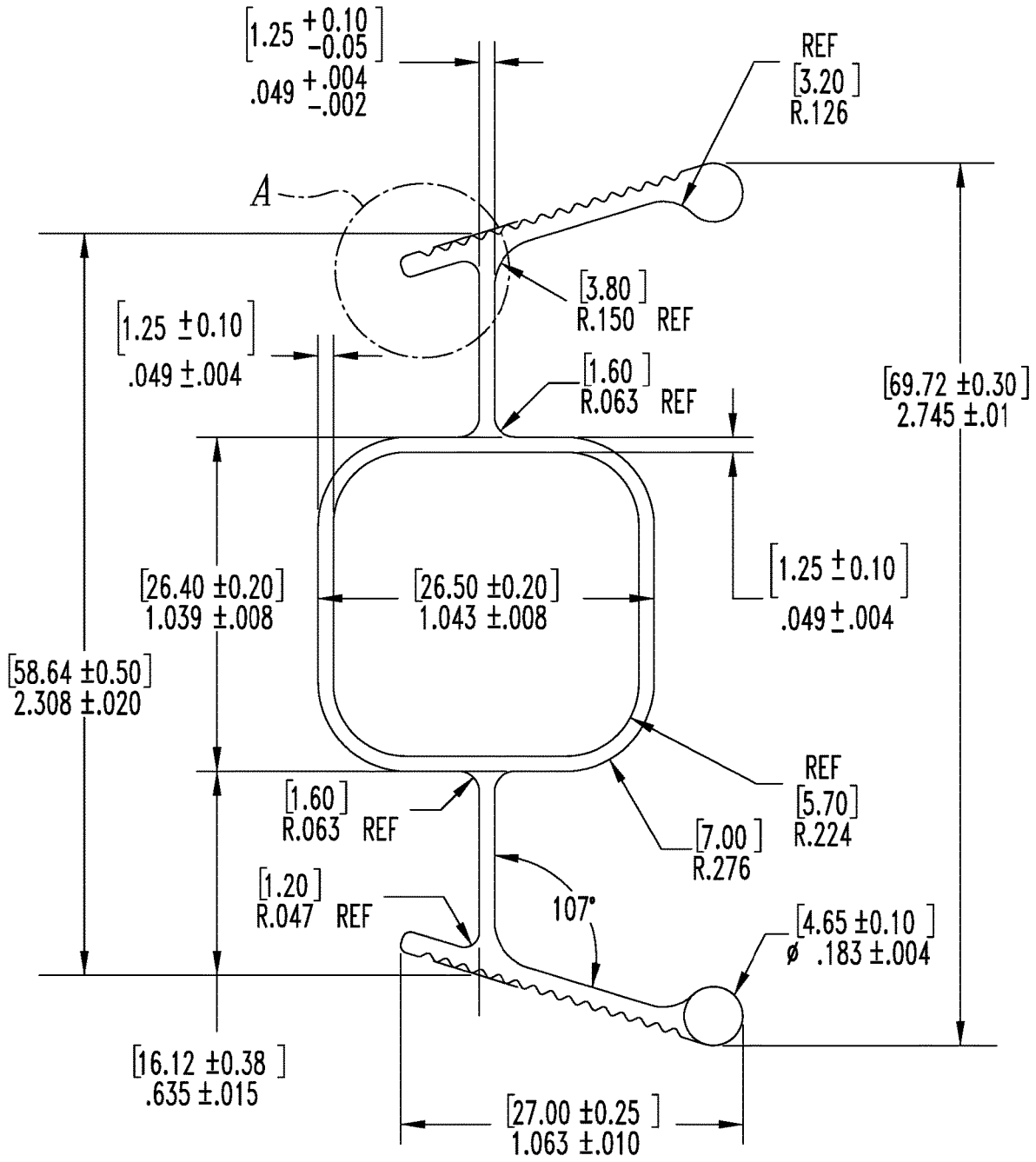
Figure 5A:
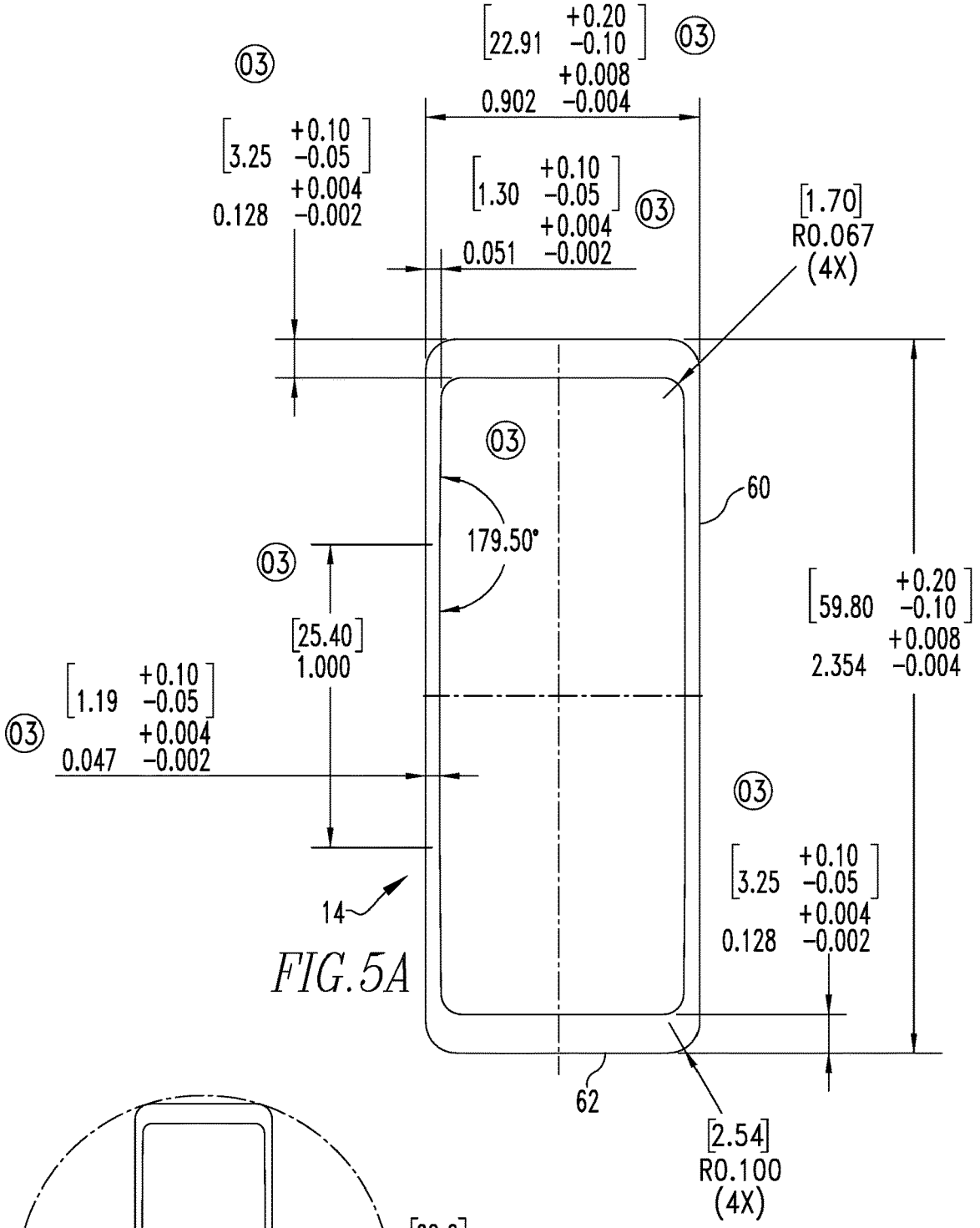
FIGS. 5A and 5B show a cross section of an inner rail of the MT ladder or a rail of a ladder.
Figure 5B:
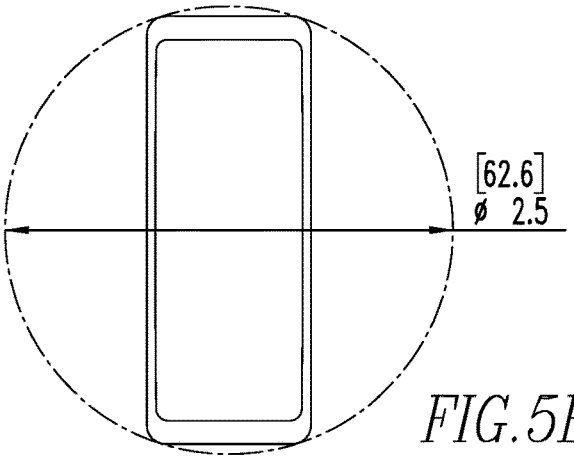

At least one of the first outer rungs 42 may be less than 1.3 MM thick, and preferably 1.25 MM thick, as shown in FIGS. 4A-4C. Preferably each of the rungs is less than 1.3 MM thick. In comparison, the thickness of an outer rung of an MT ladder made of 6000 series Al Alloy is 1.4 MM thick. The first inner rail 14 has a long side 60 which may be less than 1.5 MM thick, and is preferably 1.30 MM thick, and a short side 62 which may be less than 3.3 MM thick, and is preferably 3.25 MM thick, as shown in FIGS. 5A and 5B. In comparison, the thickness of a long side of an inner rail of an MT ladder made of 6000 series Al Alloy is 1.78 MM and the short side is 2.54 M. The first inner rail 14 is hollow. Preferably each of the inner rails has these same dimensions and architecture. The outer rails are of the same thickness and architecture of a typical outer rail for a 6000 series AL alloy MT ladder.

Figure 6:
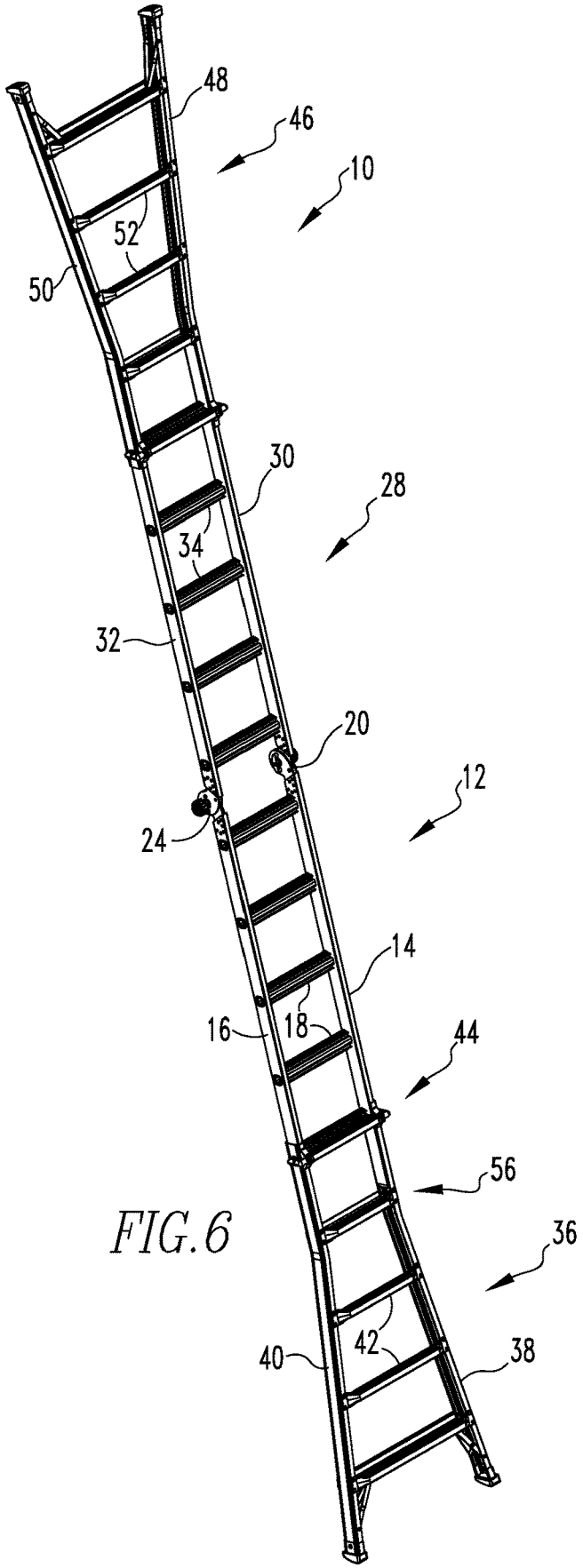
FIG. 6 is a perspective view of the MT ladder in a fully extended position.

The ladder 10 may have a length of 13 feet in an extended state, where the first inner right rail 14 is in straight linear alignment with the second inner right rail 30, has a 300 lbs. duty rating and weighs less than 25 lbs., as shown in FIG. 6. The ladder 10 may have length of 17 feet in an extended state, where the first inner right rail 14 is in straight linear alignment with the second inner right rail 30, has a 300 lbs. duty rating and weighs less than 32 lbs.

The ladder 10 may have a length of 22 feet in an extended state, where the first inner right rail 14 is in straight linear alignment with the second inner right rail 30, has a 300 lbs. duty rating and weighs less than 40 lbs. The ladder 10 may have a length of 26 feet in an extended state, where the first inner right rail 14 is in straight linear alignment with the second inner right rail 30, has a 300 lbs. duty rating and weighs less than 54 lbs.

The following is the weight comparison of Werner's existing 6000 series Al Alloy MT ladder versus the present 7000 series Al Alloy MT ladder:

| | 6000 | 7000 |
|---|---|---|
| MT-13 | 27.9 lbs | 23.8 lbs |
| MT-17 | 34.3 lbs | 30.6 lbs |
| MT-22 | 43.2 lbs | 38.3 lbs |
| MT-26 | 57.3 lbs | 51.0 lbs |

The 7000 series Al Alloy used, (7005 series AL Alloy) for the MT ladder is made of the following:

Element Result % Min % Max %
Si=0.05 0.00 0.35
Fe=0.12 0.00 0.40
Cu<0.01 0.00 0.10
Mn=0.38 0.20 0.7
Mg=1.4 1.0 1.8
Zn=4.5 4.0 5.0
Cr=0.11 0.06 0.20
Ti=0.03 0.01 0.06
Zr=0.13 0.08 0.20
OE<0.05 0.00 0.05
OT<0.15 0.00 0.15
Al=Balance
Type AA 7005 UNS A97005

The present invention pertains to a method for producing an MT ladder. The method comprises the steps of extruding a billet of 7000 series aluminum alloy into an extrusion in a shape of a rail. There is the step of cutting the extrusion at a desired length to define the rail. There is the step of bending the rail into a desired shape for a first outer right rail 38 so no cracks occur in the first outer right rail 38. There is the step of age hardening the first outer right rail 38. There is the step of constructing the ladder 10 with the first outer right rail 38, where the ladder 10 comprises a first inner section 12 having a first inner right rail 14, a first inner left rail 16 in parallel and spaced relation with the first inner right rail 14 and a plurality of first inner rungs 18 attached to the first inner left and right rail. The ladder 10 comprises a first articulated hinge 20 attached to the first inner right rail 14 with a first set of fasteners 22. The ladder 10 comprises a second articulated hinge 24 attached to the first inner left rail 16 with a second set of fasteners 26. The ladder 10 comprises a second inner section 28 having a second inner right rail 30, and a second inner left rail 32 in parallel and spaced relation with the second inner right rail 30 and a plurality of second inner rungs 34 attached to the second inner left and right rails. The second inner right rail 30 attached to the first articulated hinge 20 and the second inner left rail 32 attached to the second articulated hinge 24 so the second inner section 28 can rotate about the first and second articulated hinges 20, 24 at least 80° relative to the first inner section 12. The ladder 10 comprises a first outer section 36 having the first outer right rail 38, and a first outer left rail 40 in parallel and spaced relation with the first outer right rail 38 and a plurality of first outer rungs 42 attached to the first outer left and right rails. The first outer right rail 38 disposed about the first inner right rail 14 with the first inner right rail 14 sliding up and down relative to the first outer right rail 38. The first outer right rail 38 having a bend 56 of at least 20° outward relative to the first inner right rail 14 which defines a lower portion below the bend 56. The ladder 10 comprises a first locking bracket 44 attached to the first outer section 36 which locks the first inner right rail 14 in place relative to the first outer right rail 38 in a locked state and allows the first inner right rail 14 to slide relative to the first outer right rail 38 in the unlocked state. The ladder 10 comprises a second outer section 46 having a second outer right rail 48, and a second outer left rail 50 in parallel and spaced relation with the second outer right rail 48 and a plurality of second outer rungs 52 attached to the second outer left and right rails. The second outer right rail 48 disposed about the second inner right rail 30 with the second inner right rail 30 sliding up and down relative to the second outer right rail 48. The first and second inner right rails 14, 30 and the first and second inner left rails 16, 32 and the first and second outer right rails 38, 48 and the first and second outer left rails 40, 50 and the first and second inner rungs 18, 34 and the first and second outer rungs 42, 52 made entirely of 7000 series aluminum alloy.

The extruding step may include the step of extruding the billet at 2-4.5MM/S. The age hardening step may include the steps of maintaining the first outer rail at about 180 degrees C. for about 8 hours and then air cooling the first outer rail. The extruding step may include the steps of heating the billet to greater than 510 degrees C. and then quenching the billet. The quenching step may include the step of cooling the billet with a wind of air at least at 10 MPH and at a temperature below 70 degrees F.

In order to use 7000 Al Alloy for ladder tolerances have to be changed between parts in the hinge area to prevent cracking as compared to ladders made with softer 6000 Al Alloy. Gaps had to be reduced to keep from overstressing the material in areas that were thinned to reduce weight and take the benefit of the increased strength.

As compared to extruding 6000 Al Alloy, the extrusion rate had to be slowed down to prevent manufacturing issues because of the harder and more brittle 7000 Al Alloy unexpectedly developing weaknesses and cracking and deformities. These issues arose when pushing the 7000 series Al Alloy material through the style profiles so the extrusion rate is a very sensitive. As a generalization, the extrusion rates had to be cut in half as compared to 6000 series Al Alloy. The 6000 Al Alloys run an average of 13-15 mm/minute to form the components of the MT ladder made out of the 6000 Al Alloys, while the 7000 Al Alloys run at 3-5 mm/minute.

Details regarding the extrusion and formation of components of the MT ladder can be found in the chart of FIG. 7.

Figure 8:
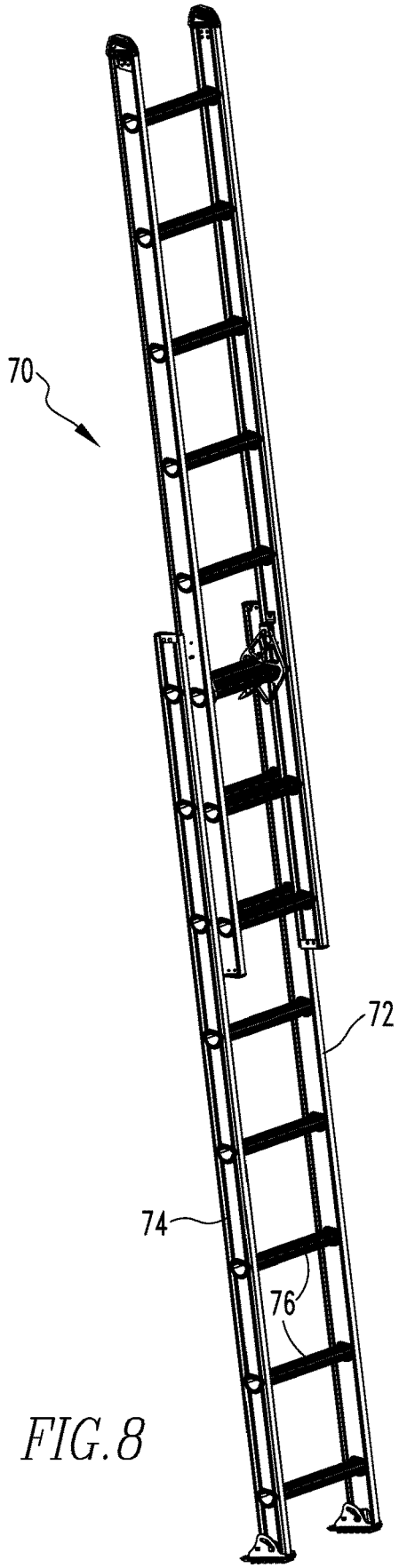
FIG. 8 is perspective view of a ladder whose rails and rungs are made of 7000 series Al Alloy.

The present invention pertains to a ladder 70, as shown in FIG. 8. The ladder 70 comprises a right rail 72. The ladder comprises a left rail 74 in parallel and spaced relation with the right rail 72. The cross section of the right rail 72 and the left rail 74 is shown in FIGS. 5A and 5B, and are the same as the inner right rail 14 described above. The ladder 70 comprises a plurality of rungs 76 attached to the left and right rails. The rungs 76 are attached to the right and left rails in the same way that rungs are attached to left and right rails of a ladder made of 6000 series Al Alloy. The right and the left rails and the rungs are made entirely of 7000 series Al alloy. The ladder 70 has a duty rating of at least 250 lbs.

The present invention pertains to a method for producing a ladder 70. The method comprises the steps of extruding a billet of 7000 series aluminum alloy into an extrusion in a shape of a rail. There is the step of cutting the extrusion at a desired length to define the rail. There is the step of age hardening the rail to define a right rail 72. There is the step of attaching a rung 76 made of 7000 series Al alloy to the right rail. There is the step of constructing the ladder 70 with the right rail 72 and the rung 76. The ladder 70 has a duty rating of at least 250 lbs.

The present invention pertains to a method for using a ladder. The ladder may be the ladder 10 or the ladder 70 described above. The method comprises the steps of moving the ladder 10, 70 to a desired location. The ladder having rails and rungs attached to the rails. The rungs and the rails made entirely of 7000 series aluminum alloy. There is the step of positioning the ladder 10, 70 for a user to climb up onto the ladder.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A multipurpose ladder comprising:

a first inner section having a first inner right rail, a first inner left rail in parallel and spaced relation with the first inner right rail and a plurality of first inner rungs attached to the first inner left and right rail;

a first articulated hinge attached to the first inner right rail with a first set of fasteners, the first articulated hinge has no cracks;

a second articulated hinge attached to the first inner left rail with a second set of fasteners;

a second inner section having a second inner right rail, and a second inner left rail in parallel and spaced relation with the second inner right rail and a plurality of second inner rungs attached to the second inner left and right rails, the second inner right rail attached to the first articulated hinge and the second inner left rail attached to the second articulated hinge so the second inner section can rotate about the first and second articulated hinges at least 80° relative to the first inner section;

a first outer section having a first outer right rail, and a first outer left rail in parallel and spaced relation with the first outer right rail and a plurality of first outer rungs attached to the first outer left and right rails, the first outer right rail disposed about the first inner right rail with the first inner right rail sliding up and down relative to the first outer right rail, the first outer right rail having a bend of at least 20° outward relative to the first inner right rail which defines a lower portion below the bend, the bend of the first outer right rail has no cracks, and the first inner right rail has no cracks;

a first locking bracket attached to the first outer section which locks the first inner right rail in place relative to the first outer right rail in a locked state and allows the first inner right rail to slide relative to the first outer right rail in the unlocked state;

a second outer section having a second outer right rail, and a second outer left rail in parallel and spaced relation with the second outer right rail and a plurality of second outer rungs attached to the second outer left and right rails, the second outer right rail disposed about the second inner right rail with the second inner right rail sliding up and down relative to the second outer right rail, the first and second inner right rails and the first and second inner left rails and the first and second outer right rails and the first and second outer left rails and the first and second inner rungs and the first and second outer rungs made entirely of 7000 series aluminum alloy; and a stack up clearance with respect to the first inner right rail and the first articulated hinge is 0.082" at maximum and 0.040" at nominal.

2. The ladder of claim 1 wherein at least one of the first outer rungs is less than 1.3 MM thick.

3. The ladder of claim 2 wherein the first inner rail has a long side less than 1.5 MM thick and a short side less than 3.3 MM thick.

4. The ladder of claim 3 has a length of 13 feet in an extended state, where the first inner right rail is in straight linear alignment with the second inner right rail, has a 300 lbs. duty rating and weighs less than 25 lbs.

5. The ladder of claim 3 has a length of 17 feet in an extended state, where the first inner right rail is in straight linear alignment with the second inner right rail, has a 300 lbs. duty rating and weighs less than 32 lbs.

6. The ladder of claim 3 has a length of 22 feet in an extended state, where the first inner right rail is in straight linear alignment with the second inner right rail, has a 300 lbs. duty rating and weighs less than 40 lbs.

7. The ladder of claim 3 has a length of 26 feet in an extended state, where the first inner right rail is in straight linear alignment with the second inner right rail, has a 300 lbs. duty rating and weighs less than 54 lbs.

* * * * *